US008342434B2

(12) United States Patent
Daley et al.

(10) Patent No.: US 8,342,434 B2
(45) Date of Patent: Jan. 1, 2013

(54) CUTTING WHEELS FOR GRINDER PUMPS

(75) Inventors: Paul J. Daley, Waterford, NY (US); George A. Earle, III, Clifton Park, NY (US)

(73) Assignee: Environment One Corporation, Niskayuna, NY (US)

( * ) Notice: Subject to any disclaimer, the term of this patent is extended or adjusted under 35 U.S.C. 154(b) by 0 days.

(21) Appl. No.: 12/868,412

(22) Filed: Aug. 25, 2010

(65) Prior Publication Data

US 2011/0049280 A1 Mar. 3, 2011

Related U.S. Application Data

(63) Continuation of application No. 12/152,403, filed on May 14, 2008, now Pat. No. 7,802,741.

(60) Provisional application No. 60/917,844, filed on May 14, 2007.

(51) Int. Cl.
*B02C 23/36* (2006.01)

(52) U.S. Cl. ..... 241/46.017

(58) Field of Classification Search .... 241/46.01–46.17, 241/55

See application file for complete search history.

(56) References Cited

U.S. PATENT DOCUMENTS 3,014,671 A * 12/1961 Thompson ..... 241/296
4,076,179 A * 2/1978 Tsukube ..... 241/46.11
4,778,336 A * 10/1988 Husain ..... 415/121.1
5,016,825 A * 5/1991 Carpenter ..... 241/46.06

* cited by examiner

*Primary Examiner* — Mark Rosenbaum
(74) *Attorney, Agent, or Firm* — Heslin Rothenberg Farley & Mesiti P.C.

(57) ABSTRACT

A cutting wheel for a grinder pump includes in one embodiment a monolithic disc-shaped base portion having a bottom surface having a plurality of integrally formed spaced-apart, downwardly-depending cutting elements disposed adjacent the peripheral edge of the disc-shaped based portion. In another embodiment, a cutting wheel for a grinder pump includes a monolithic disc-shaped base portion having a bottom surface having a plurality of integrally formed spaced-apart, downwardly-depending cutting elements disposed adjacent the peripheral edge of the disc-shaped based portion, and a plurality of integrally formed downwardly-depending paddle elements spaced-apart from the cutting elements.

33 Claims, 3 Drawing Sheets

CUTTING WHEELS FOR GRINDER PUMPS

CROSS-REFERENCE TO RELATED APPLICATIONS

This application is a continuation of U.S. patent application Ser. No. 12/152,403, filed May 14, 2008, entitled "Pump Assemblies Having A Quick-Release Latching Mechanism And Methods For Securing Pump Assemblies In A Tank," which application claims the benefit of U.S. Provisional Application No. 60/917,844, filed May 14, 2007, entitled "Grinder Pumps And Components Therefor," the entire subject matter of these applications are hereby incorporated herein by reference.

This application is also related to commonly owned pending U.S. Utility patent application Ser. No. 11/748,231 filed May 14, 2007, entitled "Wireless Liquid Level Sensing Assemblies And Grinder Pump Assemblies Employing The Same" by Capano et al., and commonly owned pending U.S. Design patent application Ser. No. 29/280,014 filed May 14, 2007, entitled "Grinder Pump Assembly" by Henry et al. The entire subject matter of these applications are hereby incorporated herein by reference.

FIELD OF THE INVENTION

This invention relates generally to grinder pumps, and more particularly to cutting wheels for grinder pumps.

BACKGROUND OF THE INVENTION

Grinder pumps are often used in low pressure systems for pumping wastewater such as sewage. A grinder pump is typically disposed in a wastewater tank in which the grinder pump includes a motor for driving a grinder mechanism for cutting or grinding solids or semisolid matter in the wastewater and a pump for pumping the processed wastewater. Grinding solids and/or semisolid matter in the wastewater allows the resulting particulate effluent to be transferred using a pump through relatively small diameter pipes without clogging.

Conventional grinder pump assemblies typically have a cutting mechanism that employs a rotating cutting wheel within a stationary ring. The stationary ring has a large number of cutting surfaces oriented generally axially or perpendicular to the direction of rotation. As shown in FIGS. 1 and 2, a typical prior art rotating cutting wheel 10 has a disc-shaped base 12 and separately attachable elongated cutting elements 20. These cutting elements have sharp cutting edges oriented axially or near axially as well. The cutter wheel's outside diameter is nearly equivalent in dimension to the stationary ring's inside diameter assuring the clearance between rotating and stationary cutting edges is kept small to improve cutting efficiency. The cutting elements are typically produced from a harder, more durable material to withstand the wear of cutting. Since suitable cutting materials will tend to be more expensive, the overall cutting wheel will oftentimes be made from an inexpensive material such as cast iron with the more exotic cutting material such as stainless steel formed into the cutting elements and mounted to the cutting wheel. The elongated cutting elements on the rotating wheel agitates the wastewater in the tank during operation. This agitation keeps the solids in suspension during pumping cycles.

There is a need for improved grinder pumps, and particularly, cutting wheels for grinder pumps.

SUMMARY OF THE INVENTION

In a first aspect, the present invention provides a cutting wheel for a grinder pump. The cutting wheel includes a monolithic disc-shaped base portion having a bottom surface having a plurality of integrally formed spaced-apart, downwardly-depending cutting elements disposed adjacent the peripheral edge of the disc-shaped based portion.

In a second aspect, the present invention provides a cutting wheel for a grinder pump. The cutting wheel includes a monolithic disc-shaped base portion having a bottom surface having a plurality of integrally formed spaced-apart, downwardly-depending cutting elements disposed adjacent the peripheral edge of the disc-shaped based portion, and a plurality of integrally formed downwardly-depending paddle elements spaced-apart from the cutting elements.

In a third aspect, the present invention provides a grinder pump having a motor, a pump, and a grinder mechanism comprising the above cutting wheels.

In a fourth aspect, the present invention provides a grinder pump assembly having a tank, and a grinder pump assembly having a motor, a pump, and a grinder mechanism comprising the above cutting wheels.

In a fifth aspect, the present invention provides a method for forming a cutting wheel for a grinder pump. The method includes forming a monolithic disc having a bottom surface having a plurality of integrally formed spaced-apart, downwardly-depending cutting elements disposed adjacent the peripheral edge of the disc-shaped based portion, and surface finishing the monolithic disc to achieve final dimensions of the plurality of cutting elements.

In a sixth aspect, the present invention provides a method for forming a cutting wheel for a grinder pump. The method includes forming a monolithic disc having a bottom surface having a plurality of integrally formed spaced-apart, downwardly-depending cutting elements disposed adjacent the peripheral edge of the disc-shaped based portion and a plurality of integrally formed downwardly-depending paddle elements spaced-apart from the cutting elements, and surface finishing the monolithic disc to achieve final dimensions of the plurality of cutting elements.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

Figure 3:
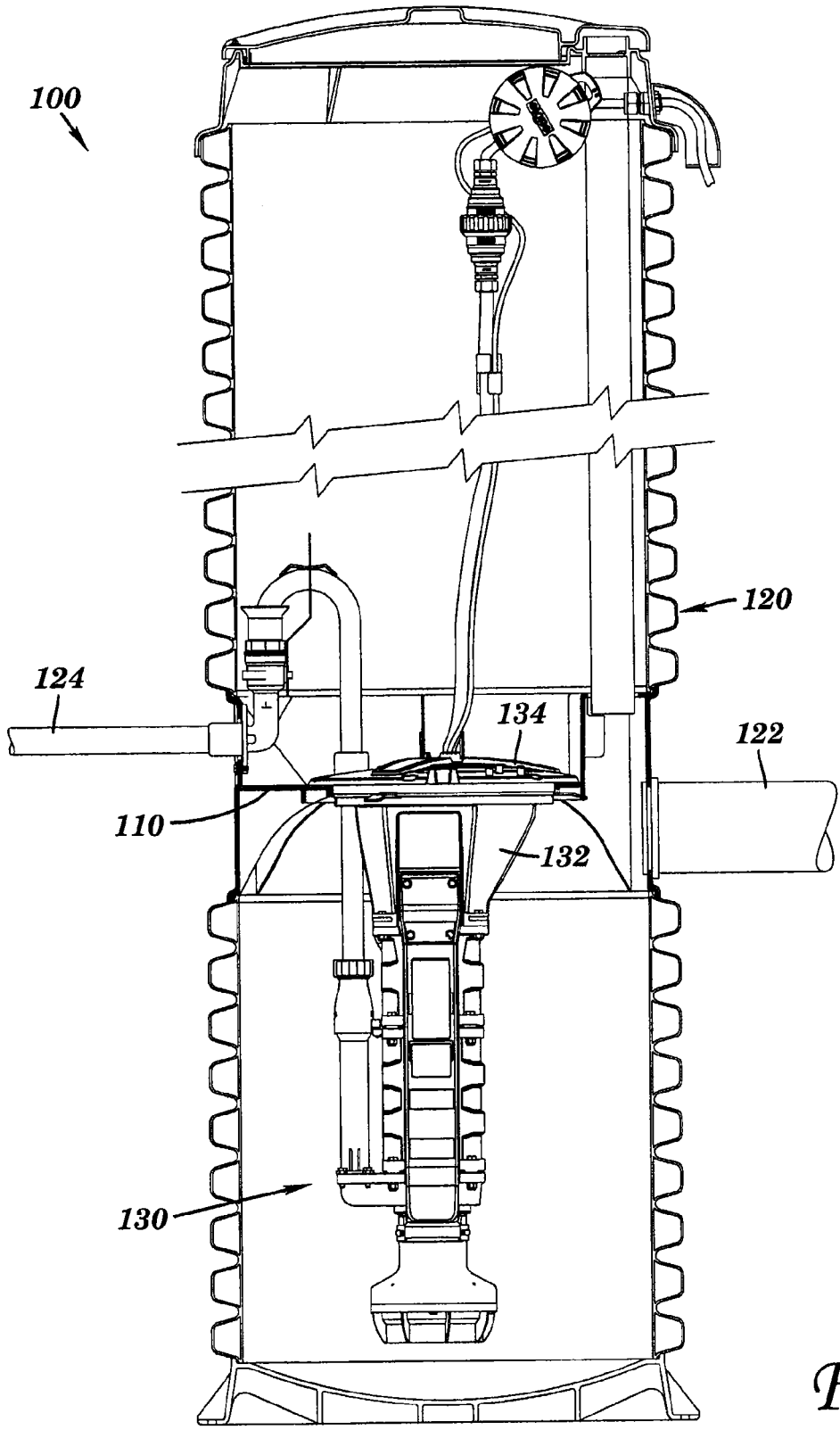
FIG. 3 is an elevational view of one embodiment of a grinder pump station employing a grinder pump having a cutting wheel in accordance with the present invention.

FIG. 3 illustrates one embodiment of a low-pressure grinder pump station 100 employing a cutting wheel in accordance with the present invention for collecting, grinding, and pumping wastewater. Grinder pump station 100 generally includes a tank 120 and a grinder pump assembly 130. In this illustrated embodiment, the grinder pump assembly is supported from the tank by a top housing 132 and a cover 134. Grinder pump station 100 is readily installable in the ground by connecting the station to a wastewater feed pipe 122, a wastewater discharge pipe 124, and an electrical power supply via an electrical cable (not shown). The system may also be connected to or include a vent.

The grinder pump assembly may include a motor for driving a grinder mechanism for cutting or grinding solids or semisolid matter in the wastewater and a pump for pumping the processed wastewater. The grinding mechanism may include a stator such as a ring having a plurality of teeth, and a cutting wheel as described in greater detail below.

Figure 4:
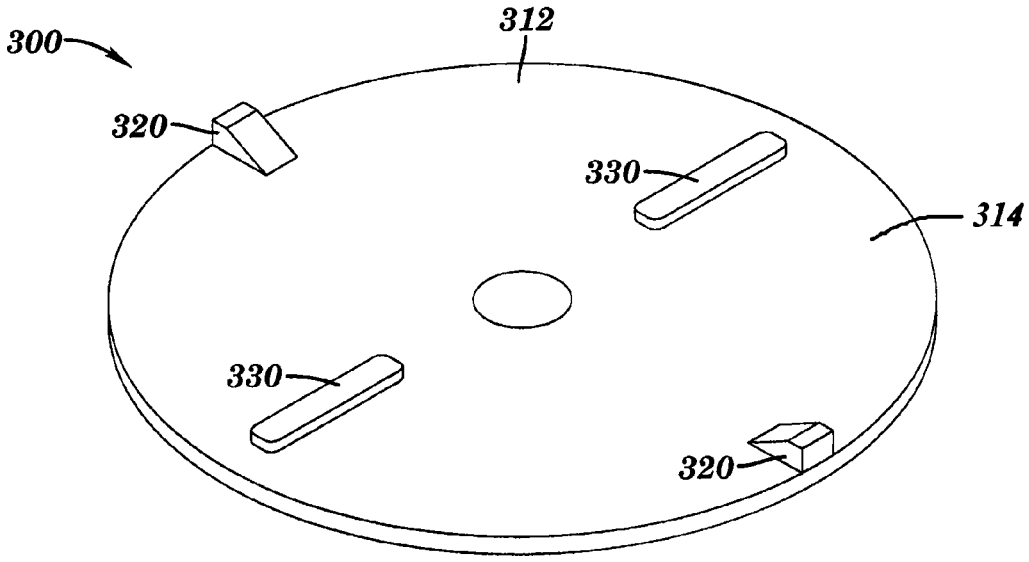
FIG. 4 is a bottom perspective view of one embodiment of a cutting wheel in accordance with an aspect of the present invention for use in a grinder pump.

FIG. 4 illustrates one embodiment of a cutting wheel 300 in accordance with one aspect of the present invention. For example, the cutting wheel may be a monolithic or one-piece cutting wheel for a grinder pump cutting mechanism. The center of the cutting wheel may have an internally threaded opening which is attached to an externally threaded end of a shaft of the motor.

Cutting wheel 300 includes a disc-shaped base portion 312 having a bottom surface 314 and a top surface, a plurality of spaced-apart cutting elements 320 and a plurality of paddle elements 330 spaced-apart from the plurality of cutting elements. The paddle elements 330 may also be spaced-apart from the peripheral edge of the disc-shaped base portion. The paddle elements allow the level of agitation to be controlled independently of the cutting teeth geometry. Cutting elements 320 may be sized smaller than the cutting elements of conventional cutting wheels.

Cutting wheel 300 may be formed from a single forging which creates the raised cutting elements as well as the paddle elements. Secondary processes such as turning or milling can be used to achieve the dimensional requirements after forging. Other forming processes such as investment casting, sintering, and metal injection molding may be employed as well. The cutting wheel may be fabricated from a suitable corrosion and abrasion resistant material. Hard chrome plating may also be employed to enhance the cutting wheels corrosion and abrasion resistance. Since the cutting edges must withstand wear and erosion over time, they can be selectively hardened, for example, with a method such as induction hardening.

A benefit of the a single-piece cutting wheel in accordance with the present invention is that the cutting wheel may be made smaller or with tighter tolerances compared to conventional cutting wheels where the cutting elements are attached to a disc-shaped base. For example, in a conventional cutting wheel, the cutting elements that are mounted to the rotating base limits the tolerance to which the outside diameter of the wheel can be held and results in a compromise in achievable clearances between the stationary and rotating cutting elements and negatively impact cutting effectiveness. By forming a monolithic or single-piece cutting wheel with integrally formed cutting elements overcomes the tolerances associated with the attaching of separate cutting elements in conventional cutting wheels.

In addition, by separating the cutting function from the agitation function, the paddles elements can be oriented with respect to the cutting elements to provide for agitation to keep the solids in suspension, as well as minimizing the localized turbulence at the region of cutting. This minimizes the turbulence that may prevent suspended solids in the wastewater from flowing into the cutting action between the cutting elements of the cutting wheel and the cutting elements of the stationary ring during the pumping cycles.

Figure 1:
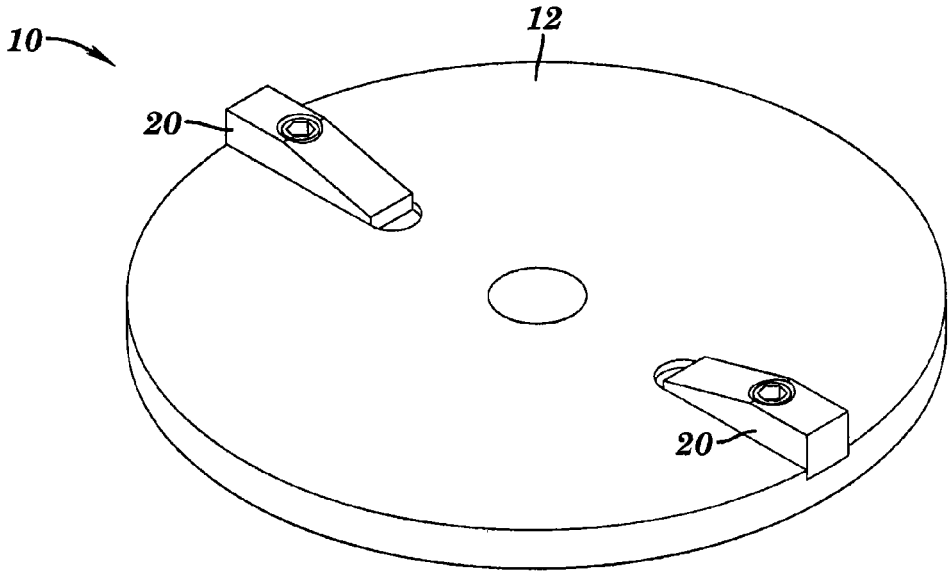
Fig. 1 PRIOR ART
FIG. 1 is a bottom perspective view of a prior art cutting wheel for a grinder pump.
Figure 2:
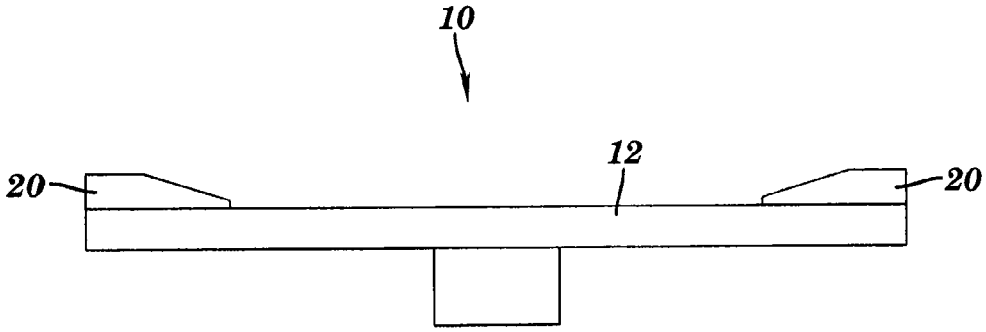
Fig. 2 PRIOR ART
FIG. 2 is a side elevation view of the prior art cutting wheel of FIG. 1.

Often, after a cutting wheel has been in service, the threaded portions of the cutting wheel and the end of the shaft of the motor may become corroded making removal difficult. Typically, when repairing a conventional grinder mechanism having a cutting wheel having separately attachable elongated cutting elements (FIG. 1), an operator will use a mallet or a tool to engage the separately attachable elongated cutting elements to aid in loosening and removing the cutting wheel from the motor shaft. By engaging the separately attachable elongated cutting elements, the cutting element can be damaged.

An advantage of the paddle elements of the monolithic cutting wheel of the present invention is that the paddle elements may be used to aid in removing the cutting wheel particularly after the cutting wheel has been in service. For example, when replacing the stator of a cutting mechanism, an operator may use a mallet or a tool to engage the paddle elements to aid in loosening and removing the cutting wheel (FIG. 4) from the motor shaft, and avoid damaging the integrally formed cutting elements. Thereafter, the stator may be removed and replaced, and the cutting wheel reinstalled.

For example, the size of the cutting wheel may be about 6 inches in diameter, the cutting elements ⅜ inch high and ½ inch long, and the paddle elements may have a height of ⅛ inch and a length of 1 inch.

Figure 5:
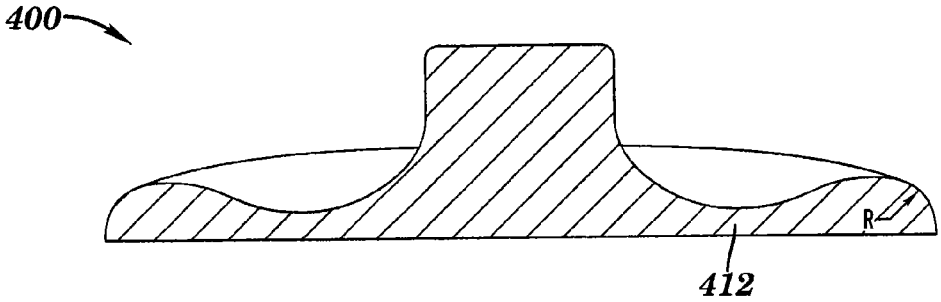
FIG. 5 is a side elevation view of another embodiment of a cutting wheel in accordance with the present invention.

FIG. 5 illustrates another embodiment of a cutting wheel 400 in accordance with the present invention. Cutting wheel 400 includes a base portion 412 having a cross-sectional profile that may improves the flow characteristics past the cutting region between the cutting elements (not shown) of the wheel, and into the inlet of the pump. For example, using gradual radii R instead of a sharp corner profile the inflow between the cutter and the pump inlet can be less disruptive. The combination of the improved cross-sectional profile, paddle elements (not shown) may be provided to allow the grinder pump unit to run more efficiently wasting less energy on excessive agitation and inlet friction head. As described above, cutting wheel 400 may be a monolithic or one-piece cutting wheel.

In addition, the cutter wheel profile can be optimized to increase the mass moment of inertia of the wheel. This inertia, or flywheel effect, helps to prevent jamming during grinding of rigid or tough materials.

In conventional grinder pump cutting wheels, the agitation has been a by-product of the size of the cutting elements rather than a purpose-designed attribute. Also, by making the cutting teeth larger to aid in mounting to the rotating wheel or to deliberately increase agitation of the wastewater, excessive, localized turbulence can be created near the rotating cutter teeth thereby making it difficult for suspended solids to flow into the cutting region and be properly macerated. There turbulence may tend to push flow away from the cutting action. Thus, the present invention for a cutting wheel may allow using smaller sized cutting teeth and the spaced-apart paddle elements may avoid some of the drawbacks of conventional grinder pump cutting wheels.

Thus, while various embodiments of the present invention have been illustrated and described, it will be appreciated to those skilled in the art that many changes and modifications may be made thereunto without departing from the spirit and scope of the invention.

The invention claimed is:

1. A cutting wheel for a grinder pump, said cutting wheel comprising:

a monolithic disc-shaped base portion having a bottom surface and a top surface, a plurality of integrally formed spaced-apart, downwardly-depending elongated cutting elements extending from said bottom surface and disposed adjacent to the peripheral edge of said disc-shaped based portion, each of said elongated cutting elements extending along a radius of said disc-shaped base portion, and having parallel elongated sides and a solid radial cross-section; and wherein said bottom surface comprises a plurality of integrally formed downwardly-depending paddle elements extending from said bottom surface and spaced-apart from said cutting elements.

2. The cutting wheel of claim 1 wherein said plurality of integrally formed downwardly-depending paddle elements are spaced-apart from a peripheral edge of said disc-shaped base portion.

3. The cutting wheel of claim 1 wherein a height of said cutting elements is greater than a height of the paddle elements.

4. The cutting wheel of claim 1 wherein a height of said cutting elements is ⅜ inch high and a length of said cutting elements is ½ inch long, and a height of said paddle elements is ⅛ inch high and a length of said paddle elements is 1 inch.

5. The cutting wheel of claim 1 wherein said cutting wheel comprises a diameter of about 6 inches in diameter.

6. The cutting wheel of claim 1 wherein a height of said cutting elements is ⅜ inch high and a length of said cutting elements is ½ inch long, a height of said paddle elements is ⅛ inch high and a length of said paddle elements is 1 inch, and said cutting wheel comprises a diameter of about 6 inches in diameter.

7. The cutting wheel of claim 1 wherein said bottom surface comprise a flat surface portion.

8. The cutting wheel of claim 1 wherein said monolithic disc-shaped base portion comprises a flat surface portion and a curved surface portion.

9. The cutting wheel of claim 8 wherein said curved surface portion comprise a rounded peripheral edge surface.

10. The cutting wheel of claim 1 wherein said disc-shaped base portion comprises a corrosion and abrasion resistant material and a hard chrome plating.

11. The cutting wheel of claim 1 wherein cutting edges of said cutting elements are induction hardened.

12. The cutting wheel claim 1 wherein said monolithic disc-shaped base portion is formed from at least one of a single forging, investment casting, sintering, and metal injection molding having said plurality of cutting elements and said plurality of paddle elements.

13. The cutting wheel of claim 12 wherein said monolithic disc-shaped base portion is formed from a secondary process comprising at least one of turning and milling to achieve final dimensions of said plurality of cutting elements and said plurality of paddle elements.

14. The cutting wheel of claim 1 wherein a height of said cutting elements is ⅜ inch high and a length of said cutting elements is ½ inch long.

15. The cutting wheel of claim 1 wherein said cutting wheel comprises a diameter of about 6 inches in diameter.

16. The cutting wheel of claim 1 wherein a height of said cutting elements is ⅜ inch high and a length of said cutting elements is ½ inch long, and said cutting wheel comprises a diameter of about 6 inches in diameter.

17. The cutting wheel of claim 1 wherein said cutting elements are about ½ inch long.

18. The cutting wheel of claim 1 wherein each of said paddle elements extends along a radius of said disc-shaped base portion.

19. The cutting wheel of claim 1 wherein said paddle elements have a generally constant radially extending cross-section.

20. The cutting wheel of claim 1 wherein said paddle elements comprise parallel side surfaces.

21. The cutting wheel of claim 1 wherein said paddle elements comprise a solid radial cross-section.

22. The cutting wheel of claim 1 wherein each of said paddle elements extends along a radius of said disc-shaped base portion, and said paddle elements comprise a generally constant radially extending cross-section, elongated parallel side surfaces, and a solid radial cross-section.

23. A grinder pump comprising:

a motor;

a pump; and grinder mechanism comprising the cutting wheel of claim 1.

24. The grinder pump of claim 23 wherein said bottom surface comprise a flat surface portion.

25. The grinder pump of claim 23 wherein said monolithic disc-shaped base portion comprises a flat surface portion and a curved surface portion.

26. The grinder pump of claim 25 wherein said curved surface portion comprise a rounded peripheral edge surface.

27. The grinder pump of claim 23 wherein said disc-shaped base portion comprises a corrosion and abrasion resistant material and a hard chrome plating.

28. The grinder pump of claim 23 wherein cutting edges of said cutting elements are induction hardened.

29. The grinder pump of claim 23 wherein said monolithic disc-shaped base portion is formed from at least one of a single forging, investment casting, sintering, and metal injection molding having said plurality of cutting elements and said plurality of paddle elements.

30. The grinder pump of claim 29 wherein said monolithic disc-shaped base portion is formed from a secondary process comprising at least one of turning and milling to achieve final dimensions of said plurality of cutting elements and said plurality of paddle elements.

31. A grinder pump comprising:

a motor;

a pump; and grinder mechanism comprising the cutting wheel of claim 6.

32. A grinder pump assembly comprising:

a tank a grinder pump assembly comprising:

a motor;

a pump; and a grinder mechanism comprising the cutting wheel of claim 1.

33. A grinder pump assembly comprising:

a tank a grinder pump assembly comprising:

a motor;

a pump; and a grinder mechanism comprising the cutting wheel of claim 6.

* * * * *